US007158022B2

(12) United States Patent
Fallon

(10) Patent No.: US 7,158,022 B2
(45) Date of Patent: Jan. 2, 2007

(54) AUTOMATED DIAGNOSES AND PREDICTION IN A PHYSICAL SECURITY SURVEILLANCE SYSTEM

(76) Inventor: Kenneth T. Fallon, 10396 Avebury Manor La., Las Vegas, NV (US) 89135

( * ) Notice: Subject to any disclaimer, the term of this patent is extended or adjusted under 35 U.S.C. 154(b) by 190 days.

(21) Appl. No.: 10/978,188

(22) Filed: Oct. 29, 2004

(65) Prior Publication Data

US 2006/0092019 A1 May 4, 2006

(51) Int. Cl.
*G08B 29/00* (2006.01)

(52) U.S. Cl. ..... 340/506; 340/505

(58) Field of Classification Search ..... 340/505, 340/506, 286.01, 286.02, 286.05, 286.06, 340/286.11, 435, 436, 572.1; 701/29, 33, 701/35

See application file for complete search history.

(56) References Cited

U.S. PATENT DOCUMENTS 4,189,719 A 2/1980 Massa et al. ..... 340/501
6,348,863 B1 2/2002 Krubiner et al. ..... 310/207
6,671,811 B1 12/2003 Diep et al. ..... 713/201
6,681,331 B1 1/2004 Munson et al. ..... 713/201
6,704,874 B1 3/2004 Porras ..... 713/201
6,758,751 B1 7/2004 Soltys et al. ..... 463/12
6,819,245 B1 * 11/2004 Dilling ..... 340/572.1
6,987,448 B1 * 1/2006 Catton et al. ..... 340/506
6,988,026 B1 * 1/2006 Breed et al. ..... 701/29

* cited by examiner

*Primary Examiner*—Van T. Trieu

(57) ABSTRACT

An invention that automatically reports and collects security surveillance problems, device diagnostics and device state information from cameras and security detection equipment. Devices may be attached to a network or attached through a device controller on a network but are not limited to that topology. Each detected occurrence is recorded for analysis and reporting to network administration centers. The device or the controller may also keep track of trend information and report that over time. The administration center produces warning alerts and notifications. These alerts and notifications may not be related to a single problem or intrusion but may be based on trend, predictive or diagnostic information using predictive algorithms. Special charts, graphs, histogram and other reports are produced by the system to aid in proactive diagnosis, problem prediction and behavior patterns. The system produces predictive information based on trend and periodic information to alert operators of potential upcoming problems and behavior.

2 Claims, 2 Drawing Sheets

DIAGRAMS

Annotated Marked-Up Drawings

Invention Title: Automated Diagnoses and Prediction in a Physical Security Surveillance System

Author: Kenneth T. Fallon

Application Number: 10/978,188

*See Appendix B: Sample List of Supported Equipment and Devices

Remote Devices (user location)

**See Appendix B: Sample List of Supported Equipment and Devices

Local Devices (secure facility)

DIAGRAMS

Figure 1 Annotated Marked-Up Drawings

Invention Title: Automated Diagnoses and Prediction in a Physical Security Surveillance System

Author: Kenneth T. Fallon

Application Number: 10/978,188

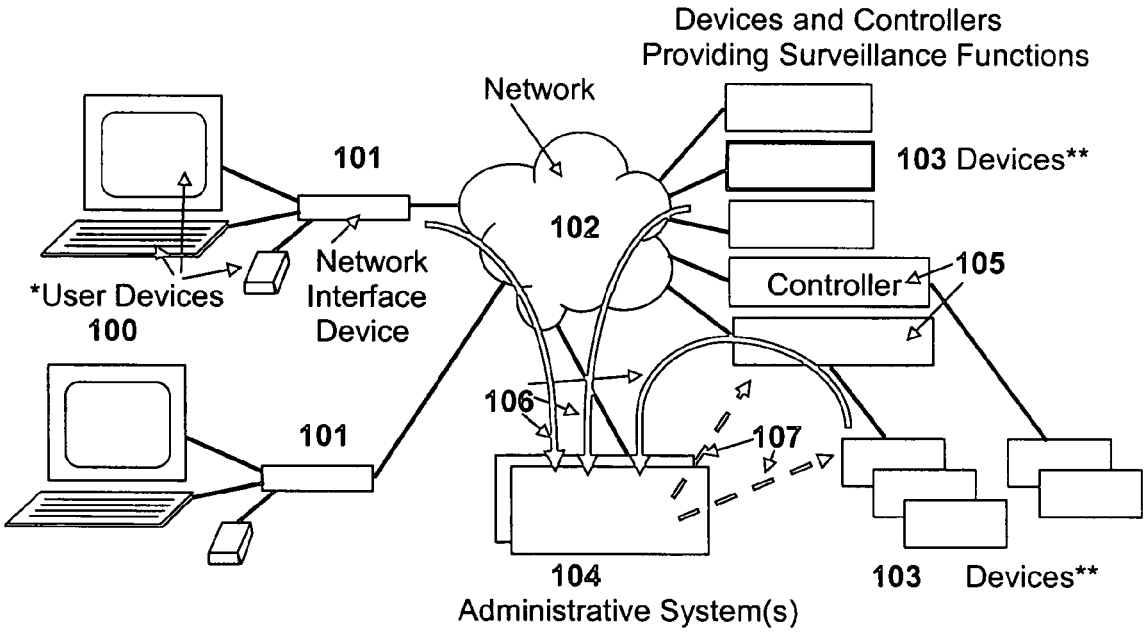

Figure 1

*See Appendix B: Sample List of Supported Equipment and Devices

Remote Devices (user location)

**See Appendix B: Sample List of Supported Equipment and Devices

Local Devices (secure facility)

Figure 2 Annotated Marked-Up Drawings

Invention Title: Automated Diagnoses and Prediction in a Physical Security Surveillance System

Author: Kenneth T. Fallon

Application Number: 10/978,188

Analysis Details and Sample Reports:

AUTOMATED DIAGNOSES AND PREDICTION IN A PHYSICAL SECURITY SURVEILLANCE SYSTEM

BACKGROUND

1. Field of Invention and Figure Description

The Automated Diagnosis and Prediction in a Physical Security Surveillance System is an invention that utilizes information collection and problem recognition to diagnose device and system information in a security surveillance system attached to cameras and detection equipment. The invention operates on computer networks and requires networked computers and surveillance equipment. The network is used to communicate between all computers and security equipment but the invention is not limited to just networked data exchange. Data may also be exchanged in any computer acceptable format if necessary. Proactive and real time diagnostic alerts, notifications and reports are produced to inform system operators and designees of network security issues. The system also produces predictive information based on trend and periodic information to alert operators of potential upcoming problems using empirical analysis predictive algorithms, predictive tracking algorithms, trend algorithms, alert threshold algorithms and other available formulas and calculations. Network attached security devices such as surveillance cameras, motions sensors, card access, bio access (retina scan, hand prints, etc.), contact sensors, detection beams, etc. are monitored by network administrative centers (a network computer) and the devices may send status updates to the network administrative centers. This collected information is processed by the administrative centers to send notifications and alerts to administrative people regarding proactive information and predictive reports on security violations, equipment operation, system operation and anticipated problems/issues. This invention provides warnings ahead of time on problems or issues within the security network. It also provides diagnostic and trend analysis reports on the operation of the security network to aid in insuring the network remains secure.

2. Description of Prior Art

Prior Art includes patents that set the stage for this patent and similar patents in another area (computer network intrusions). They introduce the technology that this patent leverages to produce its innovation. The following patents apply (more detail follows):

1. Intrusion alarm systems—U.S. Pat. No. 4,189,719
2. Method and apparatus for monitoring casinos and gaming—U.S. Pat. No. 6,758,751
3. Method and apparatus for detecting moving objects, particularly intrusions—U.S. Pat. No. 6,348,863
4. Dynamic software system intrusion detection—U.S. Pat. No. 6,681,331
5. Network-based alert management—U.S. Pat. No. 6,704,874
6. Features generation for use in computer network intrusion detection—U.S. Pat. No. 6,671,811

1. Intrusion Alarm Systems—U.S. Pat. No. 4,189,719

Abstract

An intrusion alarm system includes a microcomputer and keyboard for providing control functions for the alarm system with greater reliability and with greatly increased security as compared with prior art systems. The disclosed system provides a positive means for deactivating the alarm system only by authorized personnel by the use of a multi-digit code which must be correctly entered on the keyboard within a prescribed short period of time after entry into the protected zone. Upon entry into the protected zone, the system goes immediately into a preliminary alarm stage which, for example, may be the lighting of a floor lamp in the room. The person entering the premises then has thirty seconds to enter the correct code on the keyboard attached to the front panel of the alarm unit to deactivate the system. If an unauthorized person enters and cannot provide the required code, the system enters the final alarm stage which turns on the automatic dialer to notify the police and also turns on auxiliary sirens, outdoor lights, and any other alarm outputs that may be desired.

2. Method and Apparatus for Monitoring Casinos and Gaming—U.S. Pat. No. 6,758,751

Abstract

A system automatically monitors playing and wagering of a game. A card deck reader automatically reads a symbol identifying a respective rank and suit of each card in a deck before a first cards is removed. A chip tray reader automatically images the contents of a chip tray for verifying that proper amounts have been paid out and collected. A table monitor automatically images the activity occurring at a gaming table. Periodic comparison of the images identifies wagering, as well as the appearance, removal and position of cards and other game objects on the gaming table. The system detects prohibited playing and wagering patterns, and determines the win/loss percentage of the players and the dealer, as well as a number of other statistically relevant measures. The measurements provide automated security and real-time accounting.

3. Method and Apparatus for Detecting Moving Objects, Particularly Intrusions—U.S. Pat. No. 6,348,863

Abstract

A method and apparatus for detecting for detecting intrusions, such as intrusions through a door or window of a room, in a manner which ignores movements in other adjacent regions, is provided. The method of detecting intrusions with respect to a monitored space includes exposing the monitored space to a passive infrared sensor having a first sensor element generating a positive polarity signal when its field of view senses an infrared-radiating moving object, and a second sensor element generating a negative polarity signal when its field of view senses an infrared-radiating moving object; generating a movement signal consisting of a positive polarity signal and a negative polarity signal when both have been generated within a first time interval such as to indicate the movement of an object within the monitored space; determining from the relative sequential order of the positive polarity signal and negative polarity signal in the movement signal the direction of movement of the detected object, and particularly whether the movement direction is a hostile direction or a friendly direction; and actuating an alarm when the direction of movement of the movement signal is determined to be in the hostile direction, but not when it is determined to be in the friendly direction.

4. Dynamic Software System Intrusion Detection—U.S. Pat. No. 6,681,331

Abstract

A real-time approach for detecting aberrant modes of system behavior induced by abnormal and unauthorized system activities that are indicative of an intrusive, undesired access of the system. This detection methodology is based on behavioral information obtained from a suitably instrumented computer program as it is executing. The theoretical foundation for the present invention is founded on a study of the internal behavior of the software system. As a software system is executing, it expresses a set of its many functionalities as sequential events. Each of these functionalities has a characteristic set of modules that is executed to implement the functionality. These module sets execute with clearly defined and measurable execution profiles, which change as the executed functionalities change. Over time, the normal behavior of the system will be defined by the boundary of the profiles. An attempt to violate the security of the system will result in behavior that is outside the normal activity of the system and thus result in a perturbation of the system in a manner outside the scope of the normal profiles. Such violations are detected by an analysis and comparison of the profiles generated from an instrumented software system against a set of known intrusion profiles and a varying criterion level of potential new intrusion events.

5. Network-Based Alert Management—U.S. Pat. No. 6,704,874

Abstract

A method of managing alerts in a network including receiving alerts from network sensors, consolidating the alerts that are indicative of a common incident and generating output reflecting the consolidated alerts.

6. Features Generation for use in Computer Network Intrusion Detection—U.S. Pat. No. 6,671,811

Abstract

Detecting harmful or illegal intrusions into a computer network or into restricted portions of a computer network uses a features generator or builder to generate a feature reflecting changes in user and user group behavior over time. User and user group historical means and standard deviations are used to generate a feature that is not dependent on rigid or static rule sets. These statistical and historical values are calculated by accessing user activity data listing activities performed by users on the computer system. Historical information is then calculated based on the activities performed by users on the computer system. The feature is calculated using the historical information based on the user or group of users activities. The feature is then utilized by a model to obtain a value or score which indicates the likelihood of an intrusion into the computer network. The historical values are adjusted according to shifts in normal behavior of users of the computer system. This allows for calculation of the feature to reflect changing characteristics of the users on the computer system.

None of the patents above offer the solution presented in this invention and most are related to computer virus intrusions and not physical surveillance systems. The concept of managing security surveillance systems is new and is especially useful in law enforcement and guard agencies. The concept in this invention of using diagnostic and status information from physical security devices to report on network problems, trends and predictive behavior is uniquely new. By using the invention users are able to better manage and predict security issues in a network based physical security system.

BRIEF DESCRIPTION OF THE DRAWINGS

FIG. 1 shows an example of network connectivity to an enterprise security system. Users 100 have access to particular security systems 104 via a network 103 that may include the Internet, an intranet or any dedicated network. See Appendix A, B and C for details of devices.

DETAILED DESCRIPTION

Figure 2:
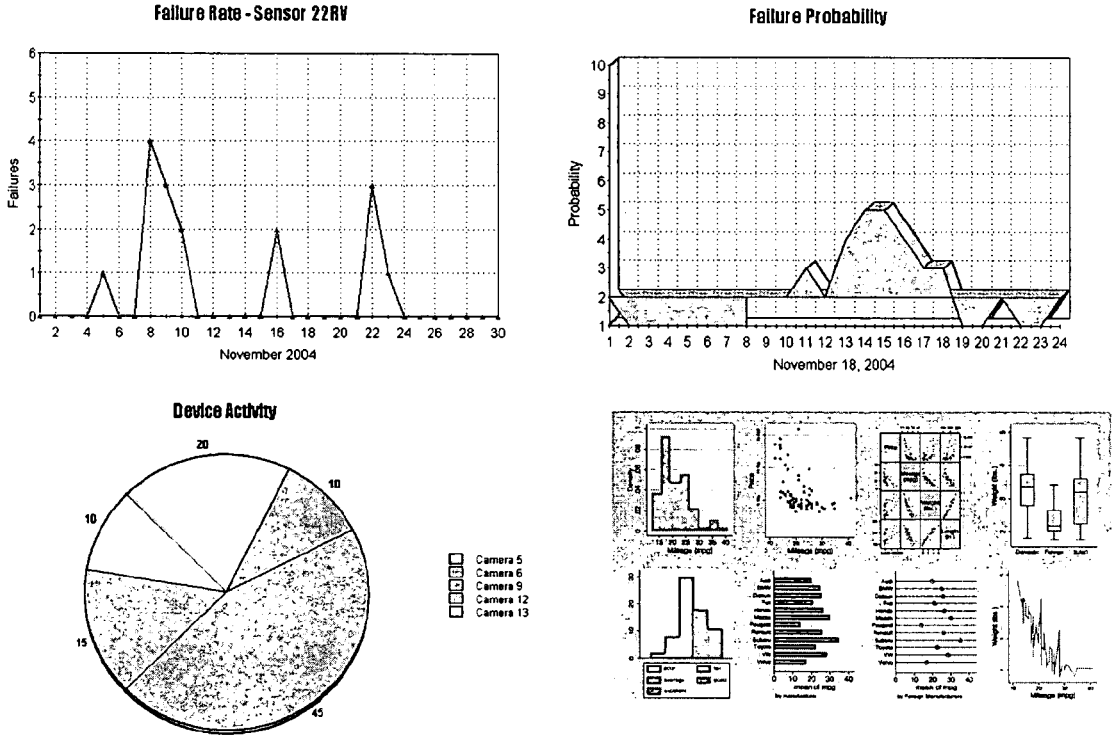
FIG. 2 shows sample analysis details and reports.

Embodiments of the present invention may be realized in accordance with the following teachings and it should be evident that various modifications and changes may be made in the following teachings without departing from the broader spirit and scope of the invention. The specification and drawings are, accordingly, to be regarded in an illustrative rather than restrictive sense and the invention measured on in terms of the claims.

Network Security System Information Collection and Reporting: The invention consists of three main functions; collecting information from physical security devices, analyzing the information and reporting the results to users and administrators. FIG. 1 shows an example of network connectivity to an enterprise security system that can use the invention. This illustrates the method of information collection which consists of the administrative center computers requesting information from devices or control units, running diagnostics on devices or control units, or receiving dynamic messages from devices or control units.

1. User devices 100 command and control the security monitoring system 104 and its devices 103. These devices may be a desktop computer, an Internet access computer, a cell phone, a handheld device, a PDA, etc. These are used to receive diagnostic and predictive information from the administrative center. They may also request information from the administrative center or directly from devices or control units.
2. The commands from the user devices come across network 101 which normally is a wireless (but not limited to wireless) network that interfaces to a backbone network 102 which may be the Internet, intranet or any dedicated type network.
3. Information exchange takes place between users 100, the security devices 103, and the security administrative center 104 controlling the flow across networks 101 and 102, producing predictive reports and delivering critical information to users.
4. The System Administrative Centers 104 receive dynamic information from device and control units via path 106. The administrative centers also request information from device and control units via path 107 and answers are returned via path 106.
5. Information and reports are sent to user devices 101 via the network.

Diagnosis Functions and Results:

After collecting security information the next step is to analyze this information and produce diagnostic and predictive results. Appendix A illustrates sample collected information by the diagnosis function. This is the process that takes place at the administrative computer centers and the results are sent to user information via user display devices. The information is in the form of alerts, notifications or reports. 201 through 210 list possibilities.

Supported Devices/Equipment Examples:

In order to be effective the invention needs to support a wide range of security devices on both the user display side and the security detection side. Appendix B shows a list of supported device/equipment types that may be attached to a security network directly or through a device controller. Items 301 through 326 give a list of the devices that include user display devices. The invention is broader than this list and it is not limited to the list contents.

Diagnoses Problems:

In order to diagnose issues and produce reports specific diagnostic information needs to be collected and categorized. Appendix C shows a list of possible diagnosis issues that lead to information collection. Items 401 through 435 present various diagnosis results and collection information. This list does not include all possible diagnosis.

Analysis Examples

FIG. 2 shows some analysis details with sample reports.

Appendix A: Intrusion and Failure System Collection Functions:

This is a list of dynamically collected information. This list is not all inclusive and other information is possible.

201 Notification of Intrusion
202 Notification if device, equipment or component failure
203 Notification of low level value or threshold for a device measurement
204 History of device or equipment operation
205 Diagnostics as the result of a request from system administrator center
206 Diagnostics report from a particular device or equipment
207 Obtain system information or device status on request
208 Collection of recorded voice tracks
209 Collection of recorded video images
210 Notification of resetting alarms and devices Appendix B: Sample List of Supported Equipment and Devices This is a list of both remote and local equipment that typifies the equipment type supported. All devices may be directly attached to a network or to a device controller that is attached to the network. The network itself may be any computer network such as wireless, Ethernet, phone, Internet, etc. Please note that this is not an inclusive list.

Remote Devices (User Location):

301 Vehicle Mobile Terminal
302 Hand Held Computer
303 Cell Phone
304 PDA—Personal Digital Assistant
305 Desktop Computer
306 Server Class Computer Local Devices (Secure Facility):

311 Surveillance Camera
312 Motion Sensor
313 Contact Sensor
314 Beam Control Sensor
315 Infrared Sensor
316 Card Reader
317 Card Key Access
318 Tag Reader
319 Retinal Scan Reader
320 Hand Print Reader
321 Light Control
322 Power Control
323 Inside Environment Control (Thermostats, etc.)
324 Door Control
325 Window Intrusion Detection
326 RF Transmitting Tag Tracking Detection Controller Appendix C: Reported and Collected Diagnosis Information:

401 Device failure, component, location, reason, failure time, recovery time
402 Device intrusion, location, reason, duration
403 Device abnormalities via status
404 Device up time
405 Device down time
406 Device intrusion frequency
407 Device failure frequency
408 Device failure trend information
409 Device intrusion frequency
410 Device intrusion trend information
411 Person access, location, time of day
412 Device threshold occurrence, location, duration, time
413 Visitor access, location, time
414 Package detection, location, time
415 Person tracking information
416 Package tracking information
417 Intrusion tracking information
418 Device scheduling information
419 User reported problem, device, component, time, duration
420 Reported problem correction, device, component, time, failure reason
421 Reported problem device trend information
422 Controller failure, component, location, reason, failure time, recovery time
423 Administrative system failure, location, reason, failure time, recovery time
424 Network failure, component, location, reason, failure time, recovery time
425 Diagnostic results, device, time, abnormalities
426 Message transfer time, start point, end point, message size
427 Status information, device, performance, abnormalities, levels/thresholds
428 Device performance trend information, location, network trunk
429 System performance trend information, network trunk
430 User system access event, user id, duration, functions
431 User system access trend information
432 Administrator system access event, user id, duration, functions
433 Administrator system access trend information
434 Officer/agent response request, time, device alert, duration
435 Officer/agent response trend information

What is claimed is:

1. A security surveillance system provides predictive security information by uniquely collecting information from security surveillance devices comprising cameras and detection equipment attached to a network, attached to device controller units on a network, or attached via electronic means and automatically report problems and status to administrative computers which save information be analyzed to determine the reason for the frequency of problems, the severity of the problems and potential future problems with the devices and the analysis will present trends and predictive behavior to include hardware failure, feature failure, network failure, operation error, human error, equipment misuse, intermittent error, externally activated error, repeated intrusions and security trend information.

2. A security surveillance system can display and report predictive behavior by the use of special predictive algorithms to create graphs, charts and reports by using uniquely collected surveillance security information from cameras or detection equipment which predicatively analyzes problems, failures, warnings, notifications, trends from selected or requesting users attached to a computer network or electronically from user display devices including desktop computers, laptop computers, mobile vehicle terminals, hand held computers, cell phones, personal digital assistants, and remote devices where after gathering information the invention runs special analysis software at administrative centers against this gathered data to identify failure trends, behavior and identifies problem areas to recommend corrective action through special reports to assist in prediction and correction of identified problems and predict behavioral or suspicious activity.

* * * * *